US011561066B2

(12) United States Patent
Mack et al.

(10) Patent No.: US 11,561,066 B2
(45) Date of Patent: Jan. 24, 2023

(54) LOCKABLE FIREARM STORAGE BOX

(71) Applicant: Hornady Manufacturing Company, Grand Island, NE (US)

(72) Inventors: Matthew Mack, Grand Island, NE (US); Thomas Delattre, Stuart, FL (US)

(73) Assignee: HORNADY MANUFACTURING COMPANY, Grand Island, NE (US)

( * ) Notice: Subject to any disclaimer, the term of this patent is extended or adjusted under 35 U.S.C. 154(b) by 160 days.

(21) Appl. No.: 16/935,972

(22) Filed: Jul. 22, 2020

(65) Prior Publication Data

US 2020/0378721 A1 Dec. 3, 2020

Related U.S. Application Data

(62) Division of application No. 15/970,448, filed on May 3, 2018, now abandoned.

(60) Provisional application No. 62/502,351, filed on May 5, 2017.

(51) Int. Cl.

| | |
|---|---|
| ***F41C 33/06*** | (2006.01) |
| ***E05B 73/00*** | (2006.01) |
| ***E05C 9/04*** | (2006.01) |
| ***E05C 9/06*** | (2006.01) |

(52) U.S. Cl.

CPC ..... *F41C 33/06* (2013.01); *E05B 73/0005* (2013.01); *E05C 9/043* (2013.01); *E05C 9/06* (2013.01)

(58) Field of Classification Search

CPC ..... F41C 33/06; E05B 73/0005; E05C 9/043; E05C 9/06

USPC ..... 206/317, 1.5; 70/63; 292/36

See application file for complete search history.

(56) References Cited

U.S. PATENT DOCUMENTS

| | | | | |
|---|---|---|---|---|
| 499,971 | A * | 6/1893 | Davis | E05B 65/0092 70/72 |
| 897,377 | A * | 9/1908 | King | E05B 65/0092 70/72 |
| 1,509,878 | A * | 9/1924 | Roberts | E05B 65/0092 70/72 |
| 1,988,408 | A * | 1/1935 | Allman | E05B 47/0002 70/278.6 |
| 4,898,408 | A * | 2/1990 | Hauber | E05B 63/0069 292/DIG. 31 |
| 5,595,076 | A * | 1/1997 | Weinerman | E05B 5/00 292/DIG. 31 |
| 6,418,760 | B1 * | 7/2002 | Fettes | A45C 13/1053 24/336 |
| 6,829,917 | B2 * | 12/2004 | Russell | F41A 23/02 292/183 |
| 9,530,266 | B2 * | 12/2016 | Delattre | G07C 9/00912 |
| 2004/0045329 | A1 * | 3/2004 | Farnham | E05B 73/0005 70/161 |
| 2009/0084785 | A1 * | 4/2009 | Nakatogawa | H01L 21/67373 220/212.5 |

(Continued)

*Primary Examiner* — J. Gregory Pickett
*Assistant Examiner* — Jenine Pagan
(74) *Attorney, Agent, or Firm* — McHale & Slavin, P.A.

(57) ABSTRACT

A lockable firearm storage box is provided. The box includes a lid and a base forming a storage chamber for a firearm. The box is provided with a locking device that includes a plurality of latching members that will secure the lid and base of the box in a closed configuration. A tether is also provided for securing the box at a given location.

18 Claims, 11 Drawing Sheets

(56) References Cited

U.S. PATENT DOCUMENTS

| | | | | |
|---|---|---|---|---|
| 2015/0053683 | A1* | 2/2015 | Becklin | F41C 33/06 220/345.6 |
| 2016/0166024 | A1* | 6/2016 | Lai | A45C 5/03 190/122 |
| 2019/0170477 | A1* | 6/2019 | Mack | E05B 47/06 |
| 2019/0231047 | A1* | 8/2019 | McLean | A45C 13/20 |

* cited by examiner

LOCKABLE FIREARM STORAGE BOX

RELATED APPLICATIONS

In accordance with 37 C.F.R 1.76, a claim of priority is included in an Application Data Sheet filed concurrently herewith. Accordingly, the present invention is a divisional application of U.S. Non-Provisional application Ser. No. 15/970,448, filed May 3, 2018, and claims priority to U.S. Provisional Patent Application No. 62/502,351, filed May 5, 2017, entitled, "LOCKABLE FIREARM STORAGE BOX", the contents of the above referenced applications are herein incorporated by reference in their entirety.

FIELD OF THE INVENTION

A lockable firearm storage box for securing such as a pistol from both access and movement from a location.

BACKGROUND OF THE INVENTION

Gun ownership has been increasing in recent years. The concern for safe storage of guns and, in particular, pistols has also increased. Safe storage has two components, the first is unauthorized use from easy access, and the second is theft. While no means has been provided which absolutely provides security for both, the goal is to make access and theft more difficult to achieve.

Numerous devices have been provided to achieve one or both goals. For example, there are numerous types of trigger locks available that make unauthorized use much more difficult by precluding easy access to the trigger of the firearm. These have been provided for both long guns, for example rifles and shotguns, and for pistols. While effective, they have no impact on theft or unauthorized movement to a different location. Because of the different shapes of trigger guards, trigger locks can be difficult to use on one firearm, while easy to use on another firearm.

Storage containers have also been provided for securing firearms. One form of a storage container is the so-called gun safe. High quality gun safes are large and very heavy, and take up a lot of space, as some can weigh on the order of 2,000 pounds. They are not easily movable and require a significant amount of time to open. They can be provided with both mechanical combination locks and electronic locks. While likely the most secure, they have the aforementioned drawbacks. Another form of storage container is a portable locking box. Numerous versions are available on the market. They are small and therefore readily portable, making theft easy, while providing a fair level of resistance to unauthorized access to a firearm contained inside. Typically, such boxes are used for the storage of pistols. Such portable boxes can be easily stored at any desired location, for example, in a drawer next to a bed, making them readily available for use in a time of need.

A typical portable locking box has a lid portion hinged to a storage base. Upon unlocking, the lid is moved to an open position, providing access to the contained firearm. However, many of these boxes can have a tool easily inserted between the lid and the base to pry the lid open. Typically, such boxes can be readily moved about a premise, or removed from the premises easily.

Thus, there is a need for an improved lockable firearm storage box.

DESCRIPTION OF THE PRIOR ART

One form of firearm storage is the so-called gun safe. It provides a high degree of security from both unauthorized access and theft. Typically, such a gun safe is also made "fireproof" or, more accurately, heat resistant for a period of time. However, they are heavy and, once in place, difficult to move within a premises. There are also limited spaces in a house or other building in which they can be placed because of their size and weight.

Another form of firearm storage is a lockbox. These tend to be small and relatively portable, allowing their positioning at any desired place within a premise. While providing resistance to unauthorized access, their ready portability provides little, if any, resistance to theft. They also tend to be built in a manner that allows opening of the box without a key or combination.

SUMMARY OF THE INVENTION

A primary objective of the present invention is to provide a firearm storage box that is resistant to both unauthorized access to the firearm inside and its movement away from a desired location.

It is a further objective of the invention to provide a firearm storage box that is difficult to open in an unauthorized manner.

It is yet another objective of the invention to provide a firearm storage box that can be secured in a desired location.

It is a still further objective of the invention to provide a firearm storage box that provides means to prevent damage to the firearm during storage.

Other objects and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

BRIEF DESCRIPTION OF THE FIGURES

FIG. 11A is a fragmentary perspective view of the locking mechanism for the box of.

DETAILED DESCRIPTION OF THE INVENTION

Figure 1:
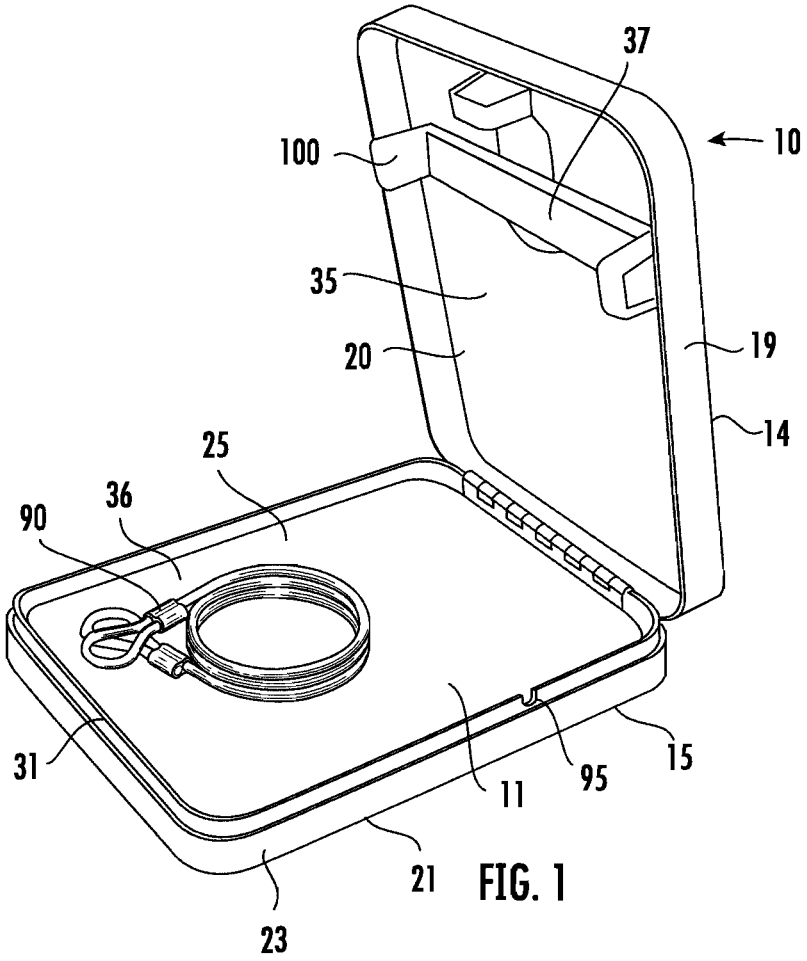
FIG. 1 is a perspective view of the exterior of a firearm storage box with the box open.
Figure 2:
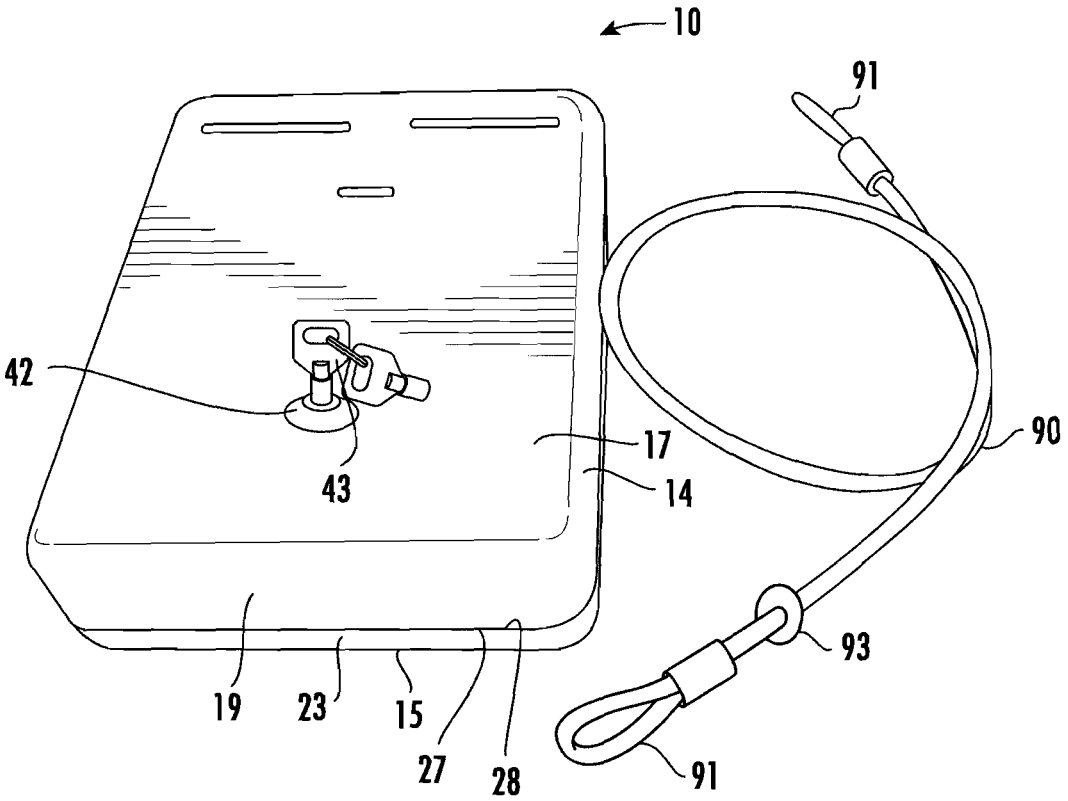
FIG. 2 is a perspective view of the firearm storage box with the lid thereof in a closed position.
Figure 3:
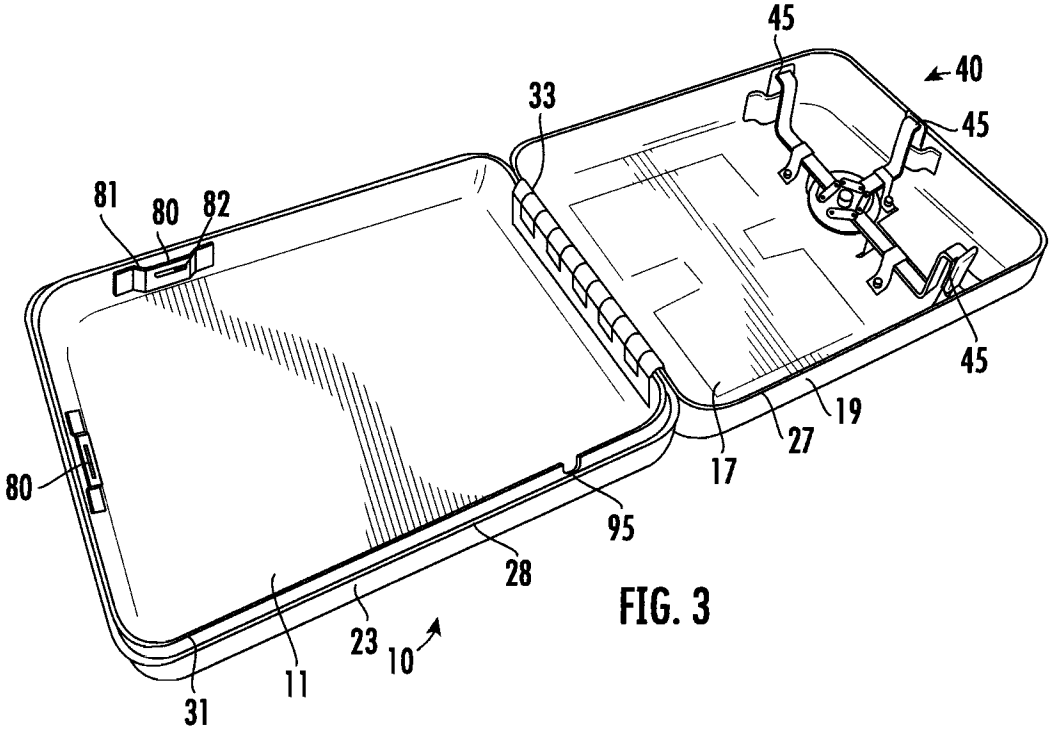
FIG. 3 is a perspective view of the firearm storage box with the lid thereof in an open position, with portions removed to show details of an internally positioned locking mechanism.
Figure 4:
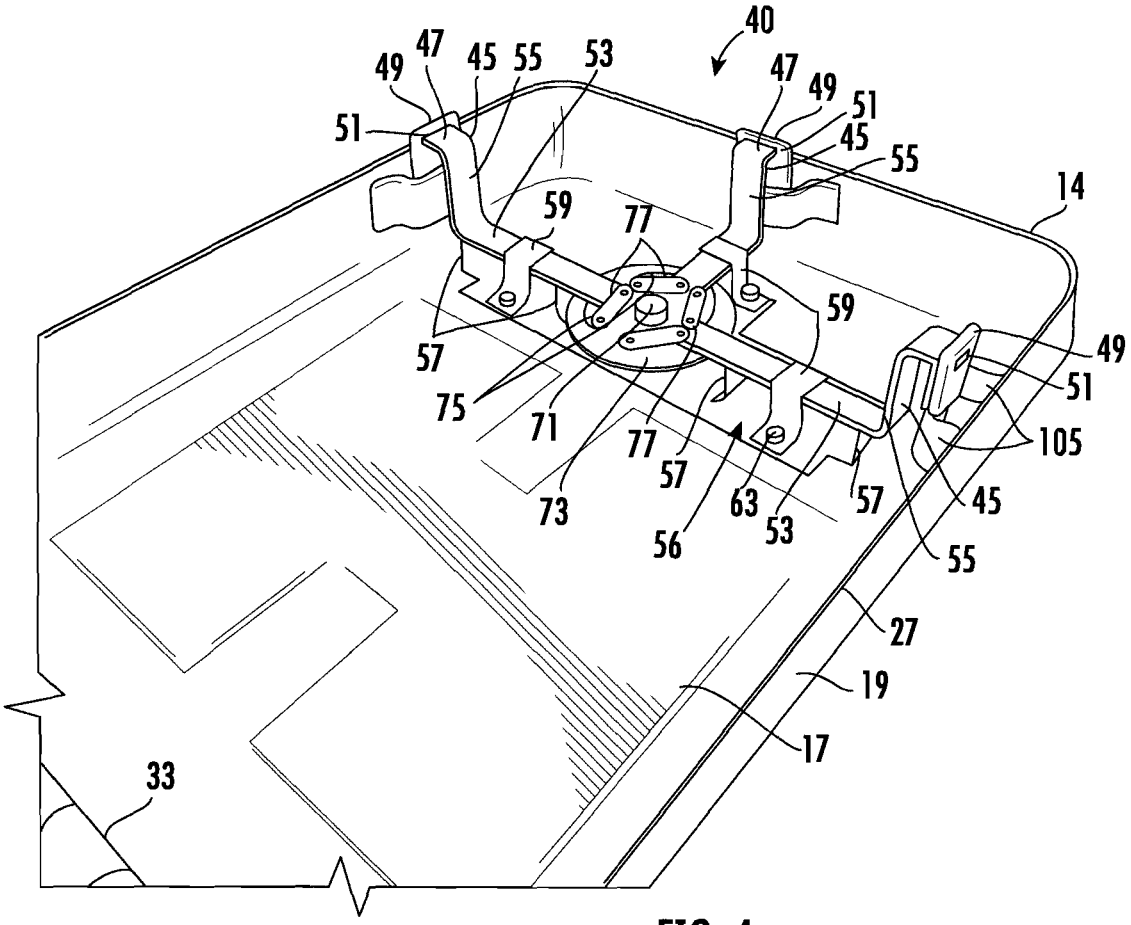
FIG. 4 is an enlarged perspective view of the firearm storage box with the lid thereof in an open position, with portions removed to show details of an internally positioned locking mechanism.
Figure 5:
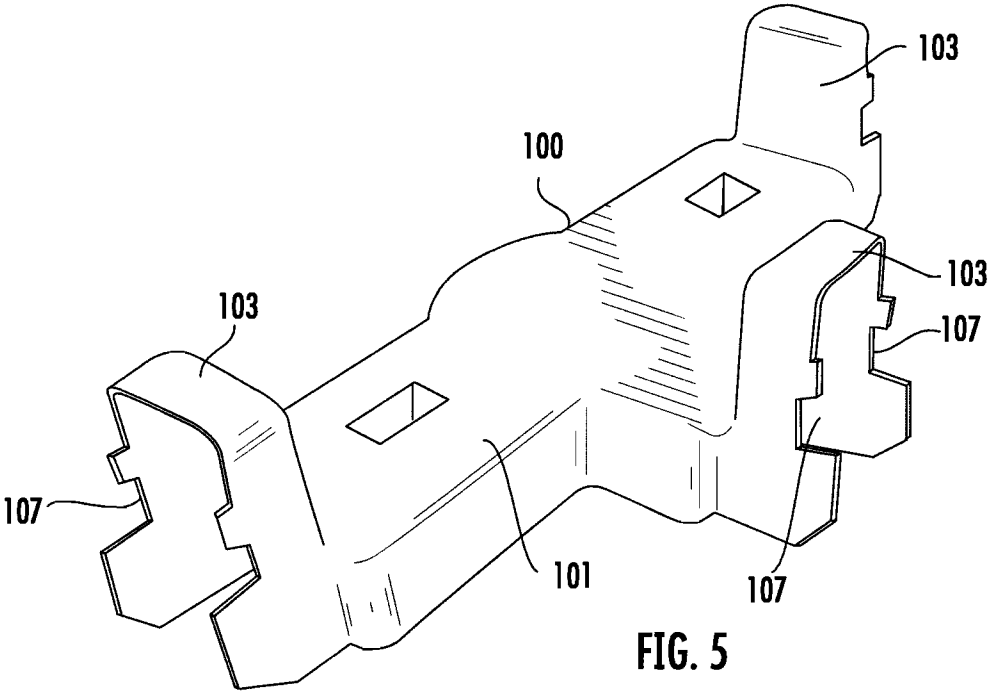
FIG. 5 is a perspective view of an internal cover removed from the storage box.

FIGS. 1-5 illustrate a first embodiment of a firearm storage box. The present invention provides a storage device usable for storing a firearm or other valuable internally in a storage chamber 11. The device is a housing having a pair of hingedly connected components that, when in a closed configuration, form the storage chamber 11. As shown and described below, the housing is in the form of a box 10 that includes both a lid portion 14 and a hingedly connected base portion 15, particularly suitable for storing a handgun. While the box 10 can be inverted, putting the base 15 on top and the lid 14 on the bottom, the differentiation is that the means for unlocking the box 10 would be on the lid. In the illustrated structure, the lid 14 and base 15 are cup shaped. The lid 14 has a main panel 17 with an upstanding sidewall 19 extending around the perimeter of the panel 17, forming a chamber portion 20 with an open side. The base 15 is similar in construction to the lid 14, having a main panel 21 with an upstanding sidewall 23 extending around the perimeter of the panel 21, forming a chamber portion 25 with an open side. The size and shape of the sidewalls 19 and 23 are similar so that their exposed edges 27, 28 mate when the lid 14 is in the closed position. In the illustrated embodiment, the base 15 is provided with an upstanding flange 31 that is positioned internally of the sidewall 23, and is received inside of, or sleeved, into the sidewall 19 when the lid 14 is in a closed position. Preferably, the flange 31 is integral with the sidewall 23, but can be formed separately and secured to the sidewall as by welding. The edge 28 forms a ledge between the sidewall 23 and flange 31, and is preferably rounded or beveled to prevent a prying tool from applying a force between edge 28 and edge 27. The lid 14 and base 15 are joined together at adjacent edges of their respective back wall portions of sidewalls 19, 23 as with a hinge 33 that permits permanent joining of the lid and base together and allows relative movement therebetween. In a preferred embodiment, the lid 14 and base 15 are formed of a metallic material such as steel, and can have a protective coating such as paint or the like thereon.

Cushions 35, 36, 37 are provided in the chambers 20, 25, respectively, to protect a firearm when stored inside the box 10. Suitable cushioning material can be open cell foam, as is known in the art. Preferably, the cushions 35, 36 can be adhered in place with a suitable adhesive.

A locking latch mechanism, designated generally 40, is provided. A lock cylinder 42 is mounted to the panel 17 of the lid 14. A preferred lock cylinder 42 utilizes a tubular key (also called a barrel key) 43 for locking and unlocking the lock cylinder 42 and associated parts. The latch mechanism 40 includes a plurality of latch members 45 operably coupled to the lock cylinder 42 to effect their movement thereby. As shown, there are three latch members 45, one each associated with a respective portion of sidewall 19. As shown, the latch members are associated with a front portion of sidewall 19 and opposite side portions of sidewall 19. A latch member 45 includes a tongue 47 that is movably mounted for extension and retraction in a respective guide 49. The guides 49 are each mounted to a respective side portion of sidewall 19 as by welding. The tongue 47 extends through a respective opening 51 to both guide a respective tongue 47 and restrict its movement, except basically linearly in extended and retracted directions. Each of the latch members 45 includes an actuating arm 53 and a bight portion 55 connecting the arm 53 to a tongue 47. As shown, an arm 53 is movably mounted in a guide assembly, designated generally 56, comprising two spaced apart supports 57 and a guiding retainer 59. As shown, the supports 57 and respective retainer 59 are mounted to the panel 21 in any suitable manner, such as by welding or mechanical fasteners 63. The mechanical fastener 63 can have portions thereof secured to the panel 21 as by welding. The lock 42 includes a housing and cylinder combination that is suitably mounted to the panel 21 as with a threaded nut (not shown, but similar to nut 274 described below) and can be keyed to the panel 21 to prevent the housing from rotating relative to the panel as described below for the lock cylinder 207 for the second embodiment 201. The lock 42 is provided with a shaft 71 that is rotatable with the lock cylinder when a key 43 is inserted and turned. The shaft 71 has a drive element 73 secured thereto and selectively rotatable thereby. The drive element 73 is operably coupled to each of the latch members 45 to effect simultaneous movement thereof upon rotation of the key 43 and a portion of the lock 42, i.e., the lock cylinder by rotation of a key 43 in the lock cylinder. In the illustrated structure, the drive element 73 is coupled to the latch members 45 in a configuration that provides a large mechanical advantage, at least at the full extension positions of the latch members 45. The large mechanical advantage is preferably at least 3:1 at the full extension position as determined by the ratio of movement of the drive element 73 to the effected movement of tongue 47. As shown, the drive element 73 is provided with a cam slot 75 for each of the latch members 45. The orientation and configuration of each of the cam slots 75 provides the mechanical advantage. The cam slots 75 provide a push/pull cam effect in operation. Each of the latch members 45 is provided with a follower 77, each received in a respective cam slot 75, whereby, upon rotation of the drive element 73, the latch members 45 can be moved inwardly (retracted) or outwardly (extended) from unlocking and locking positions respectively. The guiding retainers 59 restrain movement of each of the actuating arms 53 and tongues 47 in a generally linear path.

The base 15 is provided with a catch arrangement including a plurality of catches 80, preferably secured to the sidewall 23 as by welding. As shown, the catches 80 include a plate 81 with a through aperture 82 sized and shaped to receive a respective tongue 47 therein. Upon the tongues 47 each extending into a respective aperture 82, the lid 14 is locked in a closed position. In a preferred embodiment, the latch members 45 and respective catches 80 are positioned in about the first ⅓ of the length of the lid 14 and base 15 from the latch end to the hinge 33 end.

A second means of securing the box 10 is provided. As shown, a tether 90 is provided. The tether 90 is in the form of a cable having a loop 91 at least at one end thereof. The loop 91 is large enough to receive an opposite end of the tether 90 therethrough for securing the tether to a device, such as a bed frame or the like. The loop 91 can also be associated with a securement device such as a padlock. The tether 90 is provided with means to secure it to the box 10. In a preferred embodiment, the tether 90 is provided with a shoulder member 93 adjacent one end thereof or movable to one end thereof. The shoulder member 93 is configured to fit inside the box 10 and prevent withdrawal of the tether 90 from a closed box 10. In one embodiment, the base 15 is provided with an open ended slot 95 in the flange 31. The slot 95 is sized and shaped to receive a portion of the tether 90 therein and, when the lid 14 is closed, the tether 90 is retained within the slot 95 and the shoulder member 93 resists the tether from separating from the box 10.

A cover 100 is provided for enclosing portions of the latching mechanism 40 therein to prevent contact of the stored firearm with portions of the latching mechanism. The cover 100 can be made from a polymeric material and can be formed by injection molding or the like. Means is provided to secure the cover 100 in its enclosing position. As shown, the cover is provided with a base portion 101 that overlies the arms 53 and the drive element 73. The cover 100 is also provided with foot portions 103 that receive the bight portions 55 and portions of the tongues 47 therein to shield them from contact with a stored firearm. The guides 49 are also positioned inside of a respective foot portion 103 to shield them from contact with the stored firearm. As shown, the guides 49 each have arms 105 securing the guides 49 to a respective portion of a sidewall 19 such as by welding. The arms 105 are each received within a notch 107 in a respective foot portion 103, mounting the cover 100 to the lid 14.

Figure 8:
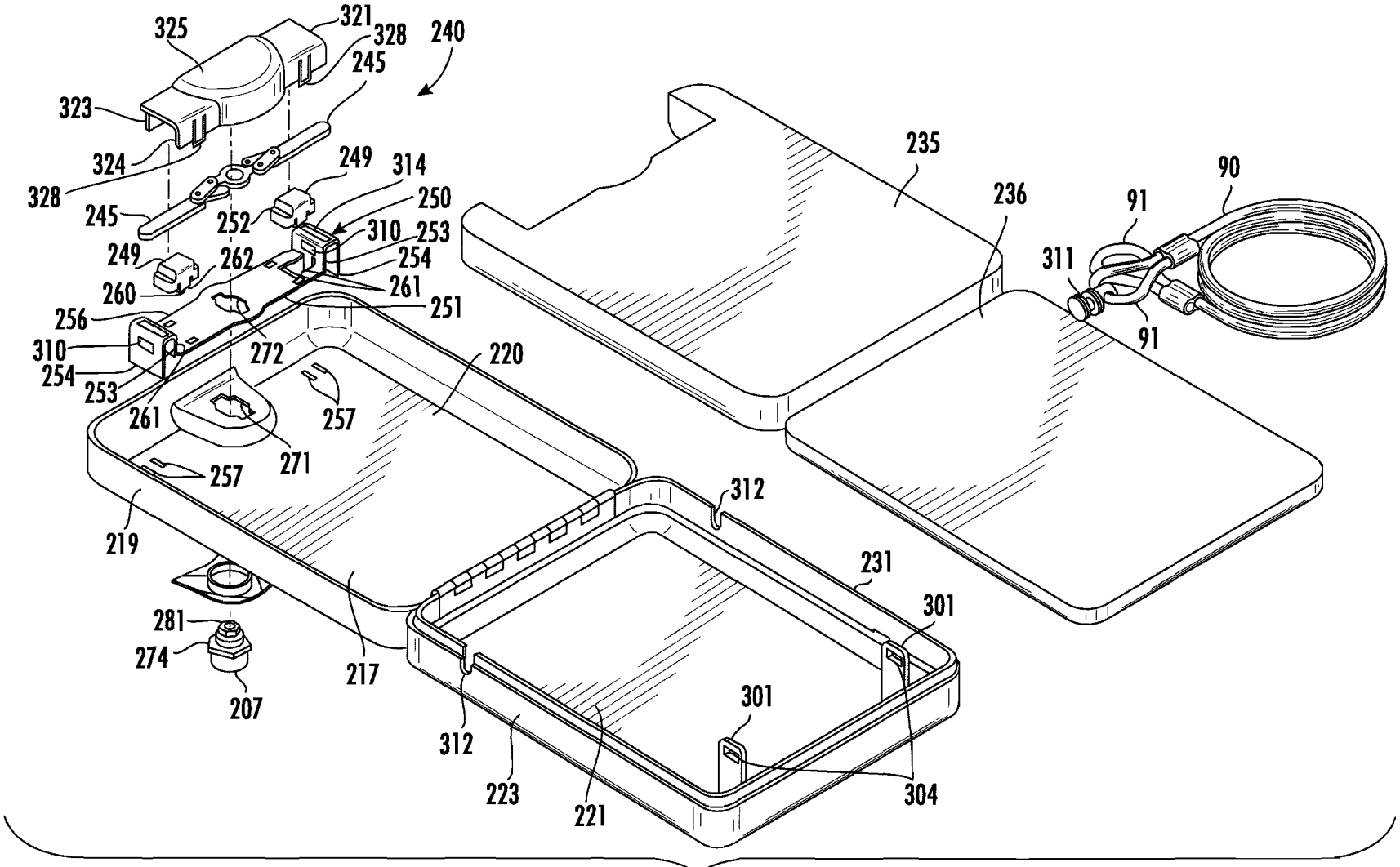
FIG. 8 is an exploded perspective view of the box of FIG. 6.
Figure 9:
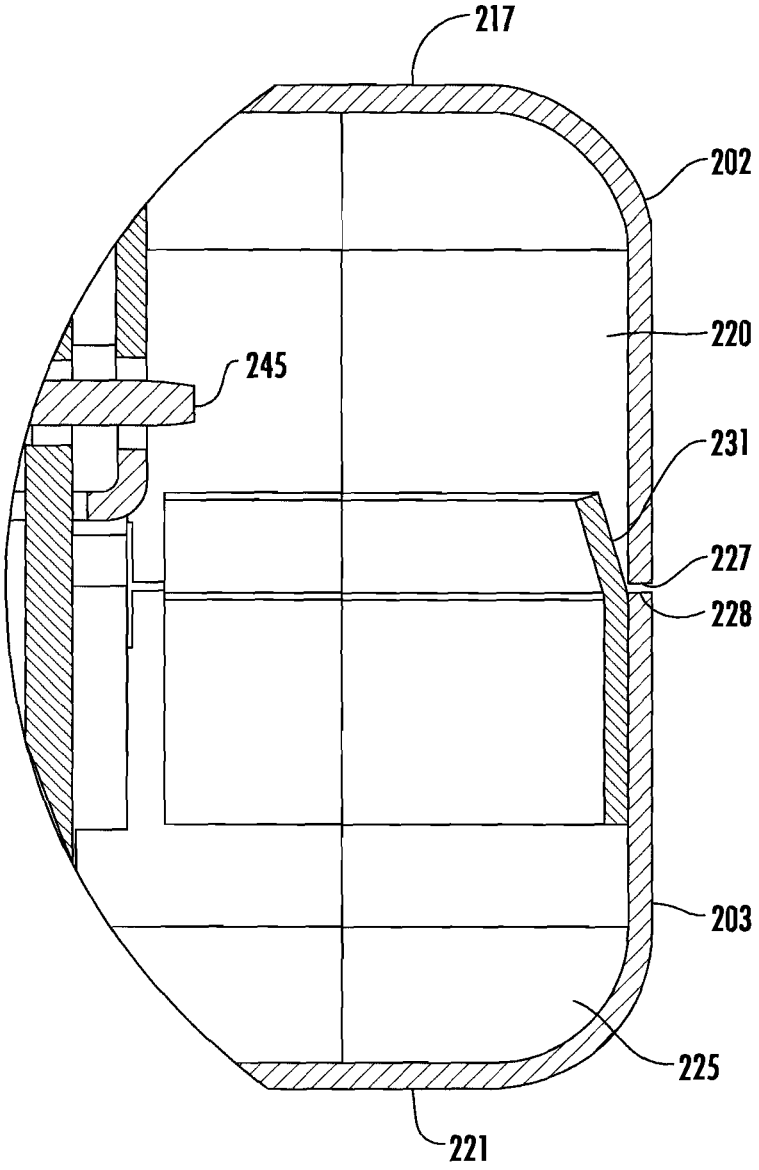
FIG. 9 is a fragmentary sectional view illustrating a sidewall portion of the box of FIG. 6.
Figures 10A, 10B, 10C, 10D:
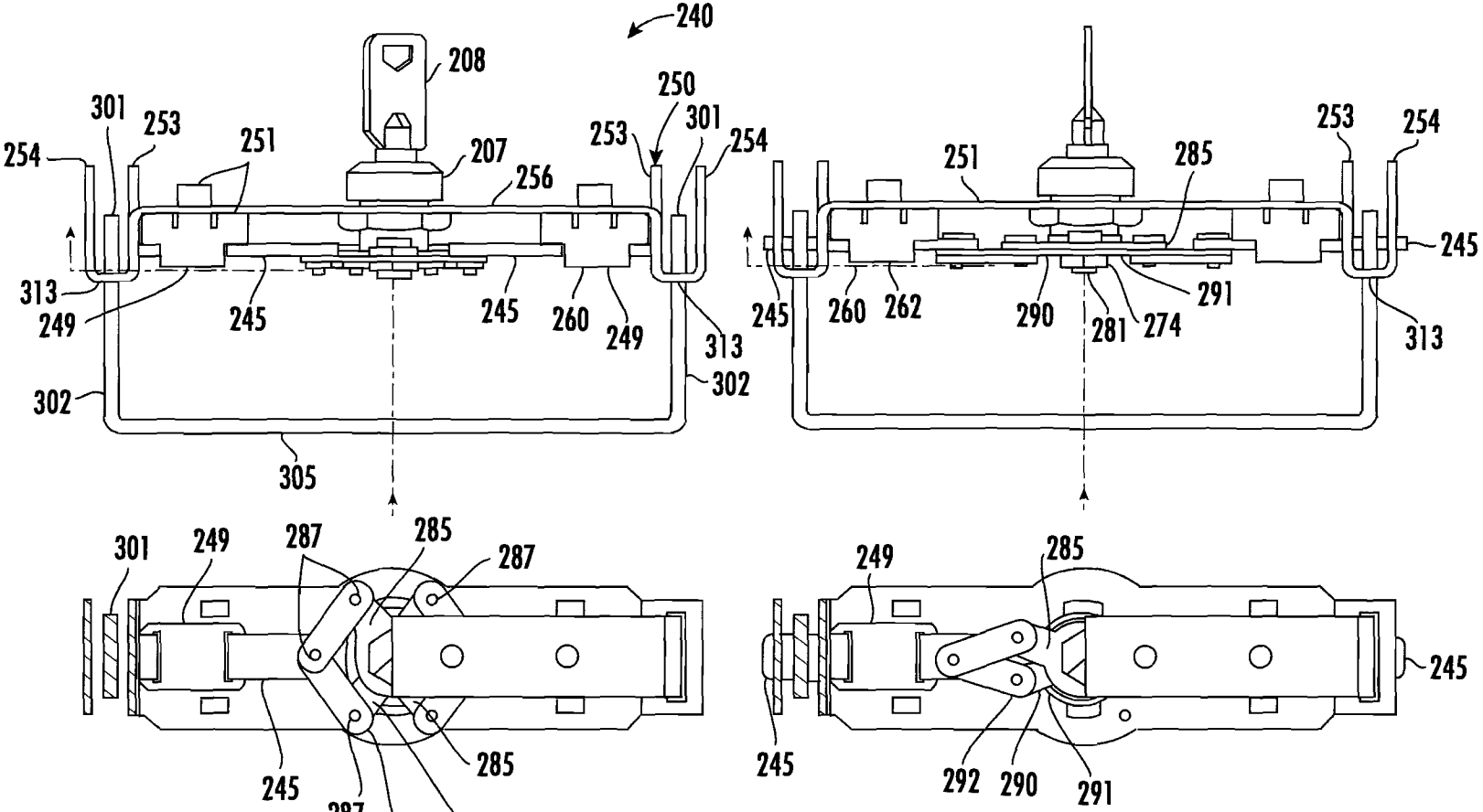
FIG. 10A is a side elevation fragmentary view of the locking mechanism in an unlocked configuration of the box of FIG. 6.
FIG. 10B is a side elevation fragmentary view of the locking mechanism as seen in FIG. 10A but with the locking mechanism in a locked configuration.
FIG. 10C is a top plan view of the locking mechanism as seen in FIG. 10A also with the locking mechanism in an unlocked configuration.
FIG. 10D is a top plan view of the locking mechanism as seen in FIG. 10B also with the locking mechanism in a locked configuration.
Figure 11A:
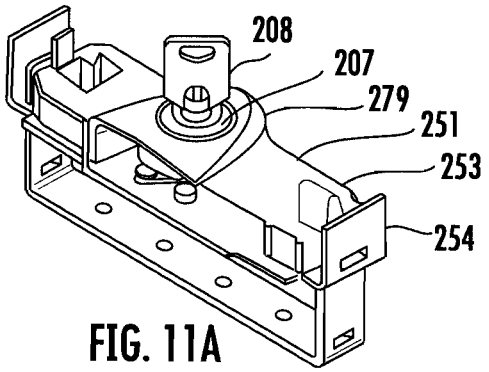
Figure 11B:
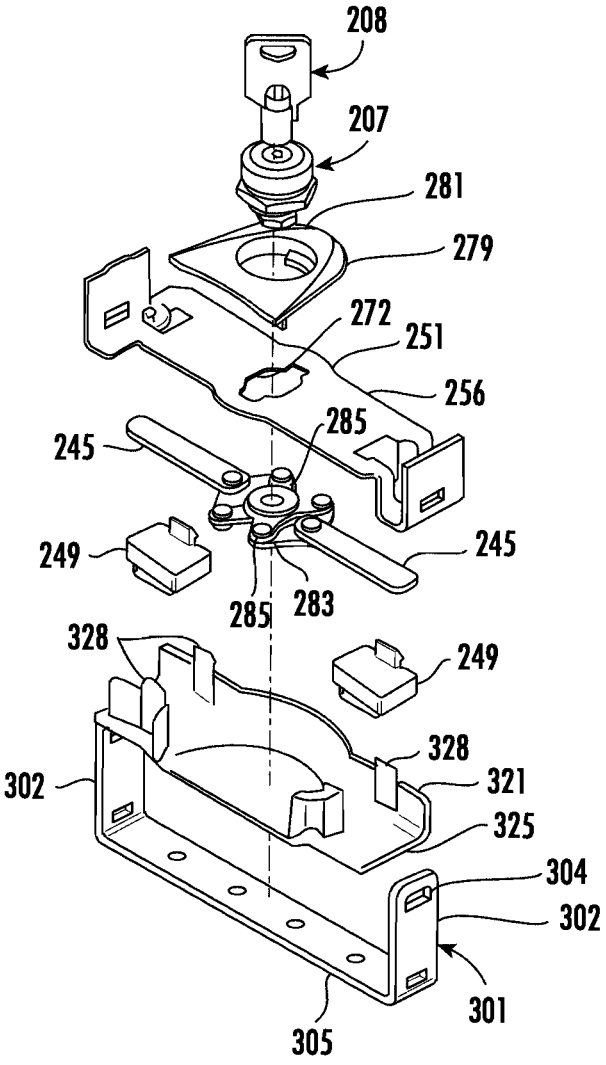
FIG. 11B is an exploded perspective view of the locking mechanism of FIG. 11A.

FIGS. 6-11 illustrate an alternate embodiment of the firearm storage box. The principal difference between this alternate firearm storage box and the above described firearm storage box is found in the locking mechanism. The reference numeral 201 designates generally the second embodiment of a firearm storage box. The box 201 includes a lid portion 202 and a base portion 203. The box 201 also includes a tether 205. The box 201 is also provided with a lock mechanism 207 that is mounted to the lid 202. The lock 207, including lock parts such as a lock cylinder and a housing, is similar to the lock cylinder 42 described above and preferably uses a tubular or barrel lock key 208, as best seen in FIG. 10.

Figure 7:
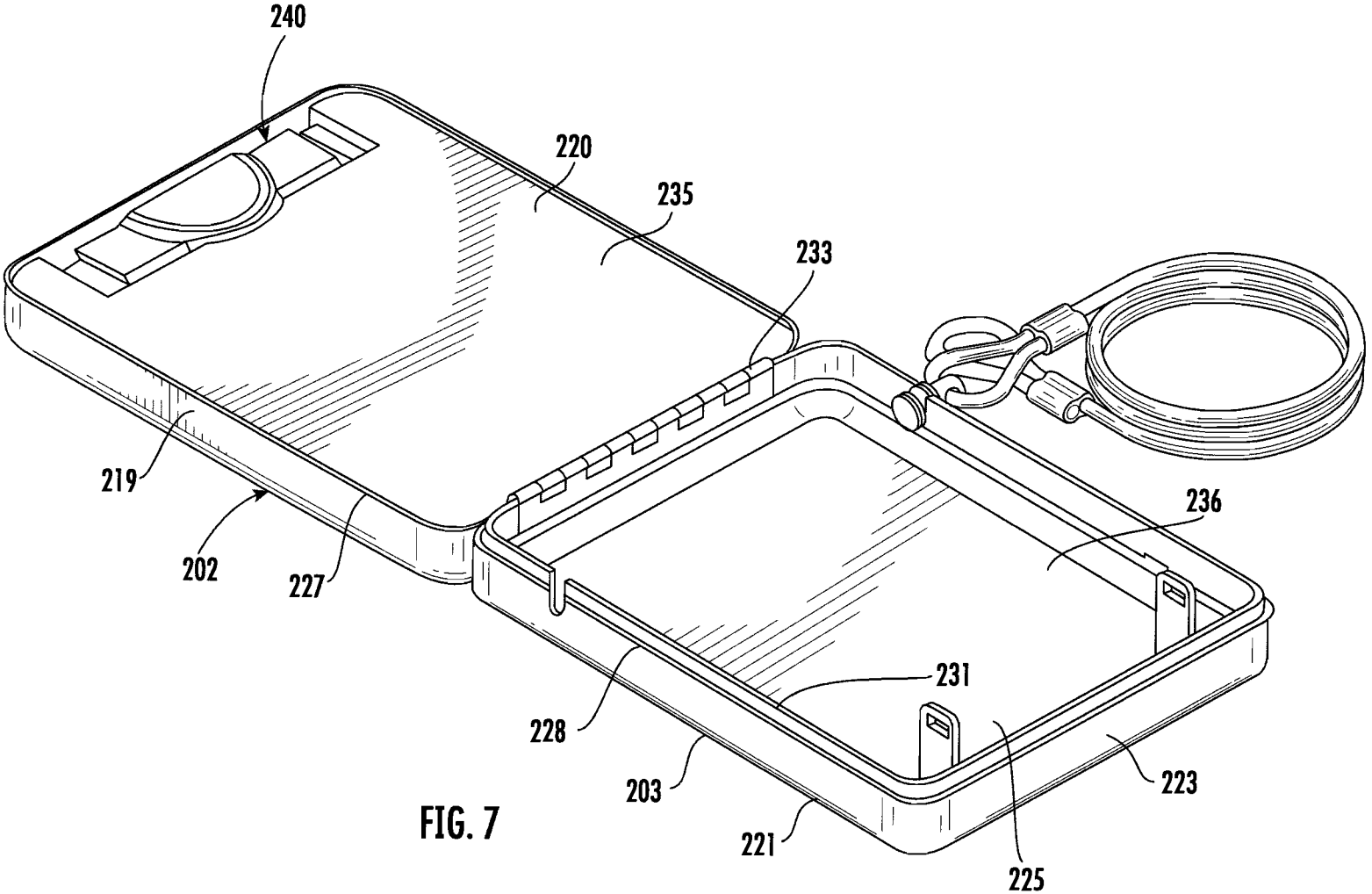
FIG. 7 is a perspective view of the box of FIG. 6 showing the box in an open configuration.

The construction of the lid 202 and base 203 is seen in FIGS. 7-9. While the box 201 can be inverted, putting the base 203 on top and the lid 202 on the bottom, the differentiation is that the means for unlocking the box 201 would be on the lid. In the illustrated structure, the lid 202 and base 203 are cup shaped. The lid 202 has a main panel 217 with an upstanding sidewall 219 extending around the perimeter of the panel 217, forming a chamber portion 220 with an open side. The base 203 is similar in construction to the lid 202, having a main panel 221 with an upstanding sidewall 223 extending around the perimeter of the base 202, forming a chamber 225 with an open side. The size and shape of the sidewalls 219 and 223 are similar so that their exposed edges 227, 228 mate when the lid 202 is in the closed position. In the illustrated embodiment, the base 203 is provided with an upstanding flange 231 that is positioned internally of the sidewall 223 and is received inside of, or sleeved, into the sidewall 219 when the lid 202 is in its closed position. Preferably, the flange 231 is integral with the sidewall 223, or can be formed as a separate part and secured to the sidewall 223 as by welding. The edge 228 forms a ledge between the sidewall 223 and flange 231, and is preferably rounded or beveled to prevent a prying tool from applying a force between the edges 228, 227. The lid 202 and base 203 are joined together at adjacent edges of their respective sidewalls 219, 223 as with a hinge 233 that permits permanent joining of the lid and base together and allow relative movement therebetween. In a preferred embodiment, the lid 202 and base 203 are formed of a metallic material, such as steel, and can have a protective coating such as paint or the like thereon.

Cushions 235, 236 are provided in the chambers 220, 225, respectively, to protect a firearm when stored inside the box 201. Suitable cushioning material can be open cell foam, as is known in the art. Preferably, the cushions 235, 236 are adhered in place with a suitable adhesive or friction.

A locking latch mechanism, designated generally 240, is provided. A lock 207 is mounted to panel 217 of the lid 202. A preferred lock 207 utilizes a tubular (or barrel) key 208 for rotating the lock cylinder of lock 207 and associated parts. Locks are well known in the art. The latch mechanism 240 includes a plurality of latch members 245 operably associated with the lock 207 to effect their movement through operation of the lock through use of the key 208. As shown, there are two latch members 245 extending in opposite directions toward a respective side portion of sidewall 219. A latch member 245 includes a portion that is movably mounted in a respective guide 249. The guide 249 is part of a guide assembly 250 that is mounted to the lid 202. The latch member 245 extends through a respective opening 252 in the guide 249 to both guide a respective latch member 245 and restrict its movement except basically linearly in two directions. The guide assembly 250 includes a support bracket 251 that is mounted to the lid 202 and preferably the panel 217. As shown, the bracket 251 has a pair of spaced apart legs 253, 254 at each end with a bight 256 extending between the pairs of legs 253. As shown, the legs 253, 254 have free ends engaging the lid panel 217, preferably each received in a respective recess 257. The guides 249 are mounted to the bight 256 as by a snap lock connection. The snap lock connection is effected by having fingers 260, each extending through a respective opening 261 and held in place with laterally extending catches 262 on the fingers 260.

The lock 207 is suitably mounted to the panel 217, preferably in a recess 267. The lock cylinder 207 extends through an opening 271 in the panel 217 and an opening 272 through the bight 256. The openings 271, 272 are shaped to cooperate with a portion of the lock 207 to positively prevent rotation of the housing portion of the lock 207 relative to the lid 202. The lock 207 is thus keyed to the panel 217 of the lid 202. A threaded nut 274 secures the lock 207, bracket 251 and lid 202 together as an assembly. A decorative cover 279 can also be secured in the recess 267. The lock 207 is provided with an output shaft 281 that is rotatable when a key is inserted and turned. The output shaft 281 is coupled to the cylinder of the lock 207. The shaft 281 has a drive element 283 secured thereto and rotatable thereby. The drive element 283 is operably coupled to each of the latch members 245 to effect movement thereof upon rotation of the key 208 and the cylinder of the lock 207. In the illustrated structure, the drive element 283 is coupled to the latch members 245 to provide a large mechanical advantage, 3:1 (as described above), for the drive element 283 to effect movement of each of the latch members 245 at least during the final movement of the latch members, effecting locking. The mechanical advantage is calculated on the movement distance of the center of the pivot pin 287 connecting the link 292 to the drive element 283 to the movement distance of the free end of the latch member 245 at the end of its extension/latching movement. As shown, the drive element 283 is provided with a pair of opposed arms 285, one for each latch member 245. A link 292 is pivotally connected to a respective latch member 245 and arm 285 as with a pivot pin 287 for each link end whereby, upon rotation of the drive element 283, the latch members 245 can be moved inwardly or outwardly for unlocking and locking respectively. The link 292 connecting the latch members 245 to the drive element 283 can move to an over center lock position, if desired, when the latch members are in their fully extended positions. The guides 249 restrain movement of each of the latch members 245 in a generally linear path. A follower 290 is rotatably mounted on the lock 207 and is driven indirectly through movement of the latch members 245 as described above. The follower 290 has a pair of arms 291 extending in opposite directions. A link 292 is pivotally connected to each arm 291 and a respective latch member 245 as with a pivot pin 287. The latch member 245 movement effects movement of a respective link 292, and hence rotation of the follower 290. Rotation of the follower 290 is opposite to the rotation of the drive element 283, and is driven indirectly by driving movement of the drive element 283.

Figure 6:
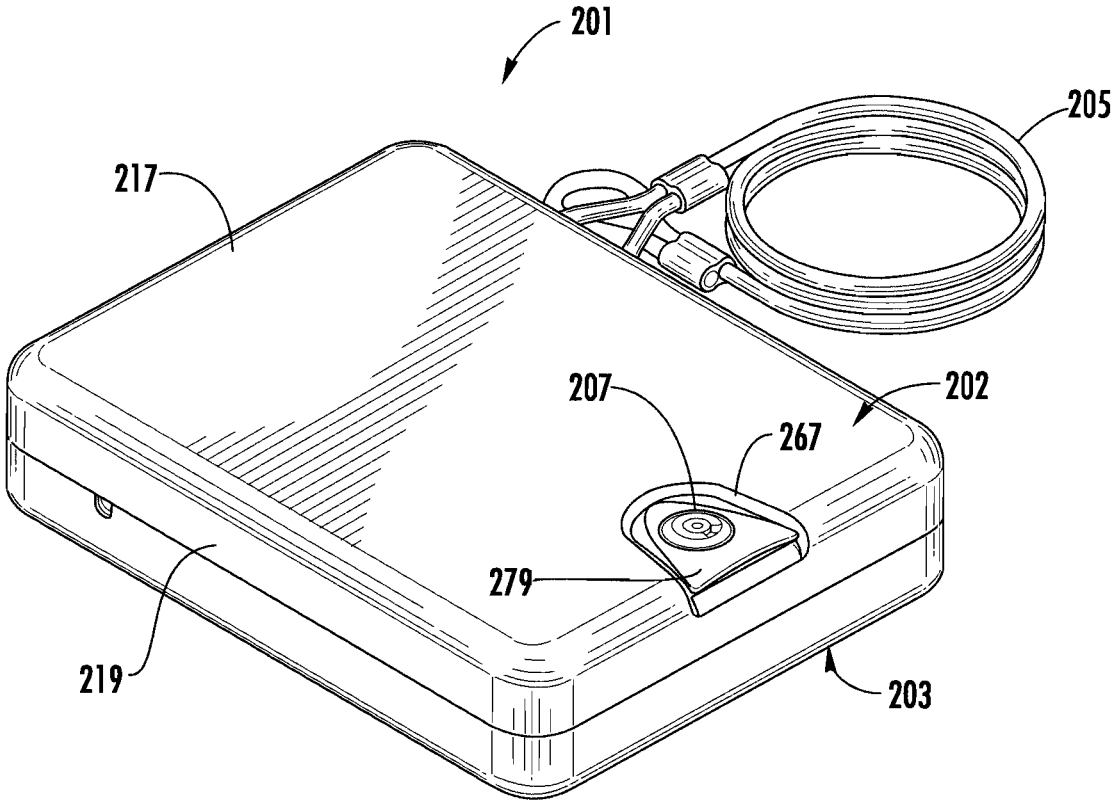
FIG. 6 is a perspective view of an alternate embodiment of a firearm storage box.

The base 203 is provided with a catch arrangement including a plurality of catches 301, preferably secured to the panel 221. As shown, the catches 301 each include an upstanding leg 302 having a through opening 304 for receipt of a respective latch member 245 therethrough to secure the lid 202 in a closed configuration, as seen in FIG. 6. The catches 301 are joined by a bight member 305 that in turn is suitably secured to the base 203 as by welding to the panel 221. The latch members 245 extend through guide assembly latch openings 310 in the legs 253, 254. In the illustrated embodiment, each pair of legs 253, 254 are connected by a respective leg bight 313. The spaced apart legs 253, 254 of a pair and a respective bight 313 form a U-shaped pocket for receipt of a respective catch 301 therein. The leg bights 313 each have a through opening 314. For closing and latching, the catches 301 extend through the openings 314 where each of the openings 304 align with a respective pair of openings 310 for receipt of a respective latch 245 therethrough, securing the lid 202 closed. Either or both of the latch 245 or legs 253, 254 would have to shear for the box 201 to be forced open. In a preferred embodiment, the latch members 245 and respective catches 301 are positioned in about the first ⅓ of the length of the lid 202 and base 203 from the distal end of the box toward the hinge 33.

A second means of securing the box 201 is provided. As shown, a tether 90 is provided. The tether 90 is in the form of a cable having a loop 91 at least at one end thereof. The loop 91 is large enough to receive an opposite end of the tether 90 therethrough for securing the tether to a device such as a bed frame or the like. The tether 90 is provided with means to secure it to the box 10. In a preferred embodiment, the tether 90 is provided with a shoulder member 311 adjacent one end thereof. The shoulder member 311 is configured to fit inside the box 10 and prevent withdrawal of the tether 90 from the closed box 10. In one embodiment, the base 203 is provided with at least one open ended slot 312 in the flange 231. The slot 312 is sized and shaped to receive a portion of the tether 90 therein and, when the lid 202 is closed, the tether 90 is retained within the slot 312 and the shoulder member 311 resists the tether from separating from the box 201. Representative tethers are also disclosed in pending applications: U.S. Pat. No. 29/559,529 entitled "Gun Safe Security Cable" filed Mar. 29, 2016, and U.S. Pat. No. 29/559,533 entitled "Gun Safe Security Case" filed Mar. 29, 2016, the disclosures of which are incorporated herein by reference.

A cover 321 is provided for enclosing portions of the latching mechanism 240 therein to prevent contact of the stored firearm with portions of the latching mechanism. The cover 320 can be made from a polymeric material and can be formed by injection molding or the like. Means is provided to secure the cover 321 in its enclosing position. As shown, the cover is provided with a base portion 325 that overlies the latch members 245 and the drive element 283. The cover 321 is provided with skirts 323, 324 connected by a base portion 325. Catches 328 extend from the skirts 323, 324 and are received through a respective through aperture in the bight 256 to form a snap together connection.

The construction of the latch mechanisms 40 and 240 positively keep the latch members 45 and 245 in their latched positions, resisting movement from externally applied force; for example, throwing the box 10 or 201 or pounding the box.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A firearm storage box comprising:

a lid including a first panel and a first sidewall forming a first storage chamber with an open side;

a base including a second panel and a second sidewall forming a second storage chamber with an open side, a first catch secured to said base;

a flange projecting from one of the first and second sidewalls and into the other of the second and first storage chambers;

a latch mechanism mounted to the lid and having a first latch member mounted for generally linear movement toward and away from said second sidewall, said first catch being associated with said first latch member, said latch mechanism including a lock mechanism operably coupled to a drive element, said drive element coupled to a pair of opposed arms, each said opposed arm rotating in an opposite direction with respect to each other upon rotation of said drive element, a pair of link members, a first end of each said link member secured to a respective end portion of each respective said opposed arm, a second end of each respective said link member secured to said first latch member through a single pivot pin connecting both link members to said first latch member, wherein rotation of said drive element in a first direction causes said opposed arms to rotate in opposite directions, converging with respect to each other, causing said first end of said pair of link members to converge, extending said first latch member to overlap a portion of said first catch, locking said lid in a closed condition, with respect to said base, and whereby rotation of said drive element in a second direction causes said opposed arms to rotate in opposite directions diverging with respect to each other, causing said first end of said link members to diverge, retracting said first latch member so as to not overlap a portion of said first catch, allowing said lid to be opened with respect to said base.

2. The firearm storage box as set forth in claim 1, wherein said latch mechanism includes a second pair of opposed arms secured to said drive element for movement in response to movement of said drive element, said second pair of opposed arms connected to a second pair of link members, a first end of each said second link member secured to a respective end portion of each respective second opposed arm, a second end of each respective said second link member secured to a second latch member, whereby rotation of said drive element in a first direction causes said second pair of opposed arms to rotate in opposite directions with respect to each other, causing said first end of said second pair of link members to converge, extending said at least one latch member to prevent opening said lid with respect to said base, and whereby rotation of said drive element in a second direction causes said second pair of opposed arms to rotate in opposite directions with respect to each other, causing said first end of said second link members to diverge, retracting said second latch member allowing said lid to be opened with respect to said base.

3. The firearm storage box as set forth in claim 2, including a second catch, said second catch positioned on a second side of said base, said second catch being associated with said second latch member such that said extending movement of said second latch member causes said second latch member to overlap a portion of said second catch, locking said lid in a closed condition, and said retracting movement of said second latch member positions said second latch member in position to not overlap a portion of said second catch, unlocking said lid.

4. The firearm storage box as set forth in claim 1, including a first guide assembly operably associated with said first latch member to guide movement of said first latch member in a respective generally linear path into and out of said first catch.

5. The firearm storage box as set forth in claim 3, including a second guide assembly operably associated with said second latch member to guide movement of said second latch member in a respective generally linear path into and out of said second catch.

6. The firearm storage box as set forth in claim 1, wherein said converging motion of said first opposed arms and said first pair of link members are configured to provide a mechanical advantage of said drive member with respect to said first latch member of at least 3:1.

7. The firearm storage box as set forth in claim 3, wherein said converging motion of said first opposed arms and said first pair of link members are configured to provide a mechanical advantage of said drive member with respect to said first latch member of at least 3:1.

8. The firearm storage box as set forth in claim 1, including a tether selectively connectable to at least one of the lid and base, said tether having a shoulder member engageable with an interior surface of at least one of the first sidewall, the second sidewall, and the flange, selectively resisting separation of the tether from the storage box.

9. The firearm storage box as set forth in claim 1, wherein said latch mechanism is secured within said base, a first catch secured to said lid, said first catch being associated with said first latch member such that said extending movement of said first latch member causes said first latch member to overlap a portion of said first catch, locking said lid in a closed condition, and said retracting movement of said first latch member positions said first latch member in position to not overlap a portion of said first catch, unlocking said lid to allow rotation of said lid with respect to said base.

10. The firearm storage box as set forth in claim 9, wherein said latch mechanism includes a second pair of opposed arms secured to said drive element for movement in response to movement of said drive element, said second pair of opposed arms connected to a second pair of link members, a first end of each said second link member secured to a respective end portion of each respective second opposed arm, a second end of each respective said second link member secured to a second latch member, whereby rotation of said drive element in a first direction causes said second pair of opposed arms to rotate in opposite directions with respect to each other causing said first end of said pair of link members to converge, extending said at least one latch member to prevent opening said lid with respect to said base, and whereby rotation of said drive element in a second direction causes said second pair of opposed arms to rotate in opposite directions with respect to each other causing said first end of said second link members to diverge retracting said second latch member, allowing said lid to be opened with respect to said base.

11. The firearm storage box as set forth in claim 10, including a second catch, said second catch positioned on a second side of said base, said second catch being associated with said second latch member such that said extending movement of said second latch member causes said second latch member to overlap a portion of said second catch, locking said lid in a closed condition, and said retracting movement of said second latch member positions said second latch member in position to not overlap a portion of said second catch, unlocking said lid.

12. The firearm storage box as set forth in claim 11, including a first guide assembly operably associated with said first latch member to guide movement of said first latch member in a respective generally linear path into and out of said first catch, a second guide assembly operably associated with said second latch member to guide movement of said second latch member in a respective generally linear path into and out of said second catch.

13. The firearm storage box as set forth in claim 1 including a key for rotation of said lock mechanism and said drive element.

14. A firearm storage box comprising:

a lid including a first panel and a first sidewall forming a first storage chamber with an open side;

a base including a second panel and a second sidewall forming a second storage chamber with an open side;

a flange projecting from one of the first and second sidewalls and into the other of the second and first storage chambers;

a latch mechanism mounted to the lid and having a first latch member mounted for generally linear movement toward and away from said second sidewall, said latch mechanism including a lock mechanism operably coupled to a drive element, said drive element coupled to a pair of opposed arms, each said opposed arm rotating in an opposite direction with respect to each other upon rotation of said drive element, a pair of link members, a first end of each said link member secured to a respective end portion of each respective opposed arm, a second end of each respective said link member secured to said first latch member, whereby rotation of said drive element in a first direction causes said opposed arms to rotate in opposite directions, causing said first end of said pair of link members to converge, extending said first latch member to prevent opening said lid with respect to said base, and whereby rotation of said drive element in a second direction causes said opposed arms to rotate in opposite directions with respect to each other, causing said first end of said link members to diverge, retracting said first latch member, allowing said lid to be opened with respect to said base, latch mechanism including a second pair of opposed arms secured to said drive element for movement in response to movement of said drive element, said second pair of opposed arms connected to a second pair of link members, a first end of each said second link member secured to a respective end portion of each respective second opposed arm, a second end of each respective said second link member secured to a second latch member, whereby rotation of said drive element in a first direction causes said second pair of opposed arms to rotate in opposite directions with respect to each other, causing said first end of said second pair of link members to converge, extending said at least one latch member to prevent opening said lid with respect to said base, and whereby rotation of said drive element in a second direction causes said second pair of opposed arms to rotate in opposite directions with respect to each other, causing said first end of said second link members to diverge, retracting said second latch member, allowing said lid to be opened with respect to said base.

15. The firearm storage box as set forth in claim 14, wherein said latch mechanism is secured within said lid, a first catch secured to said base, said first catch being associated with said first latch member such that said extending movement of said first latch member causes said first latch member to overlap a portion of said first catch, locking said lid in a closed condition, and said retracting movement of said first latch member positions said first latch member in position to not overlap a portion of said first catch, unlocking said lid.

16. The firearm storage box as set forth in claim 15, including a second catch, said second catch positioned on a second side of said base, said second catch being associated with said second latch member such that said extending movement of said second latch member causes said second latch member to overlap a portion of said second catch, locking said lid in a closed condition, and said retracting movement of said second latch member positions said second latch member in position to not overlap a portion of said second catch, unlocking said lid.

17. The firearm storage box as set forth in claim 14, wherein said latch mechanism is secured within said base, a first catch secured to said lid, said first catch being associated with said first latch member such that said extending movement of said first latch member causes said first latch member to overlap a portion of said first catch, locking said lid in a closed condition, and said retracting movement of said first latch member positions said first latch member in position to not overlap a portion of said first catch, unlocking said lid to allow rotation of said lid with respect to said base.

18. The firearm storage box as set forth in claim 17 including a second catch, said second catch positioned on a second side of said base, said second catch being associated with said second latch member such that said extending movement of said second latch member causes said second latch member to overlap a portion of said second catch, locking said lid in a closed condition, and said retracting movement of said second latch member positions said second latch member in position to not overlap a portion of said second catch, unlocking said lid.

* * * * *